United States Patent [19]

Siblik et al.

[11] Patent Number: 4,762,347

[45] Date of Patent: Aug. 9, 1988

[54] SECURITY DOOR AND LOCK ASSEMBLY

[75] Inventors: Allen D. Siblik, Lindenhurst, Ill.; James C. Babusek, Twin Lakes, Wis.

[73] Assignee: Hallen Products, Ltd., Gurnee, Ill.

[21] Appl. No.: 78,964

[22] Filed: Jul. 29, 1987

[51] Int. Cl.[4] ..... E05C 1/04

[52] U.S. Cl. ..... 292/147; 292/302

[58] Field of Search ..... 292/138, 145, 147, 163, 292/175, 302, 327

[56] References Cited

U.S. PATENT DOCUMENTS

| | | | |
|---|---|---|---|
| 88,959 | 4/1969 | Hopkins | 292/327 |
| 1,351,117 | 8/1920 | Newhall | 292/302 |
| 1,432,640 | 10/1922 | Szalai | 292/145 |
| 1,512,632 | 10/1924 | O'Connor | 292/327 |
| 2,264,962 | 12/1941 | Adams | 292/147 |
| 3,945,671 | 3/1976 | Gerlach | 292/327 |
| 3,951,443 | 4/1976 | Barnaby | 292/327 |
| 4,013,311 | 3/1977 | Prezioso | 292/59 |
| 4,414,829 | 11/1983 | Nielsen, Jr. et al. | 292/327 X |
| 4,626,009 | 12/1986 | Burnett | 292/327 |

FOREIGN PATENT DOCUMENTS

| | | | |
|---|---|---|---|
| 462068 | 3/1937 | United Kingdom | 292/302 |
| 1181879 | 2/1970 | United Kingdom | 292/302 |

OTHER PUBLICATIONS

Enterprise Hose Tube Door EBW 784 (undated advertisement).

*Primary Examiner*—Richard E. Moore

*Attorney, Agent, or Firm*—McCaleb, Lucas & Brugman

[57] ABSTRACT

A security door assembly for enclosing the ends of filling and discharge hose storage tubes employed on over the road tank trucks and trailers is disclosed wherein pivotally interconnected cover door and support frame members are formed with interfitable male and female marginal lugs having coaxially aligned openings receptive of an axially moveable lock bolt whereby movement of the bolt in one direction serves to interlock the lugs and movement of the bolt in the opposite direction serves to release such lugs. A detent is provided for removably maintaining the bolt in locking and releasing positions and a stop member cooperates with the bolt to provide limited movement of the bolt in a lug releasing direction. A manually engageable member is provided on the bolt for actuating the same.

11 Claims, 2 Drawing Sheets

SECURITY DOOR AND LOCK ASSEMBLY

This invention relates generally to security systems and more particularly to improved means for releasably retaining a security closure in closed position.

BACKGROUND OF THE INVENTION

Over the road tank trucks and trailers for transporting bulk materials such as dry and liquid chemicals, petroleum, milk, and like products, frequently utilize large diameter semi-rigid filling and discharge hoses which are coupled between appropriate fittings on the tank and remote fittings at the supply or discharge terminals. Such hoses are usually made up of elongated sections having a length in the order of 20 feet.

When not in use for filling or discharging the tank containers the hose lengths are usually stored in elongated cylindrical housings or "hose tubes" carried adjacent the tank and having the open ends thereof fitted with some type of closure means so that the hose sections are readily accessible when needed, but otherwise are secured against loss or theft when not in use.

Presently known closure means for this purpose comprise annular frames fitted over and secured to the ends of the cylindrical storage tubes and a cap or closure door pivotally joined to the frame for cooperation with the latter in enclosing the storage tube ends. The frame and cap or door are usually provided with peripheral extensions for permitting the use of a padlock to lock the door in closed position. One such known door assembly employs an elongated cantilever spring means which is attached to the door frame in a manner permitting the spring means to pivot across the door against a wedge for maintaining the door closed under spring pressure. This closure system is relatively cumbersome and inconvenient to use and operate and is susceptible to breakage and damage of the spring particularly by interferance with washing equipment, such as power brushes and the like. In addition since the spring must be pivoted to a non-interfering position in order to release the door, it is inconvenient to use on adjacent storage tubes. Thus there is a need for an improved, simplified, positive acting security system for hose tube doors and the like to which the present invention is directed, although its teachings and concepts are applicable to other types of closure environments.

BRIEF SUMMARY OF THE INVENTION

In brief, the present invention is directed to a new, improved, simple and direct acting security lock and door assembly particularly useful for closing the open ends of hose storage tubes or similar closure environments and which obviates the shortcomings of previous known closure systems employed for this purpose.

To this end the present invention is broadly directed to improved locking means comprising axially actuated, locking pin or bolt means moveable through coaxial openings provided in cooperating intermateable male and female lugs or projections. More specifically, this invention concerns the combination of a door and door frame with means for releasably interlocking such door and frame. The improved locking means of this invention comprises detent means for maintaining the bolt in selected locking or releasing positions. A surface portion of the bolt is formed for cooperation with transverse stop means arranged to limit movement of the bolt in one direction and prevent its disassociation from the male and female projections or lugs associated with the door and frame. A pull ring is coupled to the outer end of the bolt for manually actuating the same and limiting movement thereof in the opposite direction.

It is an important object of this invention to provide an improved lock assembly for securing a closure member in closed position.

It is another object of this invention to provide a security door and lock assembly particularly useful for securing closure means to a support frame in which cooperating male and female projections on the closure means and frame are adapted to be releaseably coupled together.

Still another object of this invention is to provide an improved security lock means having an axially moveable member operable with intermating male and female projections and including means preventing detachment of the axial moveable member from the projections.

A still further object of this invention is to provide a simple, economical locking means for interlocking cooperating male and female members which affords improved economies of production and maintenance as well as simplicity of operation and improved security characteristics.

Having described this invention, the above and further objects, features and advantages thereof will be apparent to those familiar with the art from the following description of a preferred embodiment thereof illustrated in the accompanying drawings and representing the best mode presently contemplated for enabling those familiar with the art to practice this invention.

IN THE DRAWINGS

DESCRIPTION OF THE PREFERRED EMBODIMENT

Figure 1:
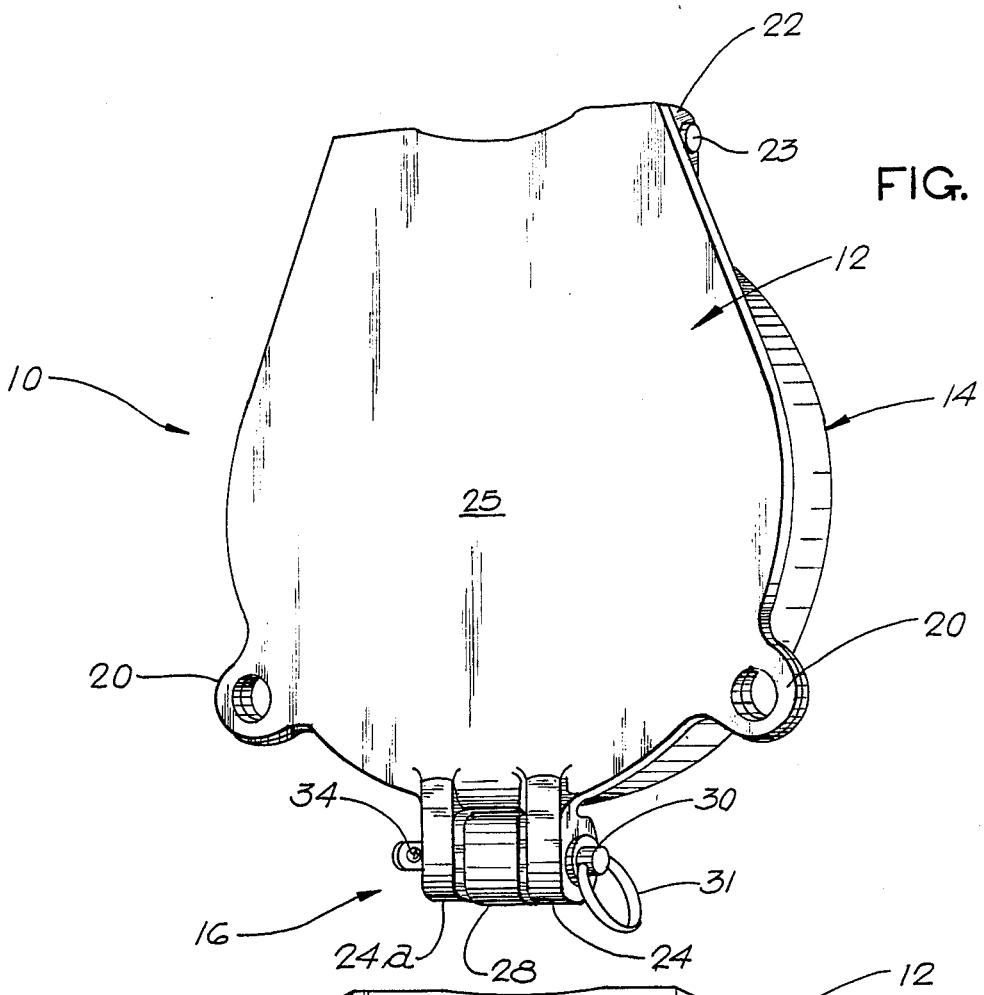
FIG. 1 is a perspective illustration of a door and lock assembly embodying the features of this invention.
Figure 2:
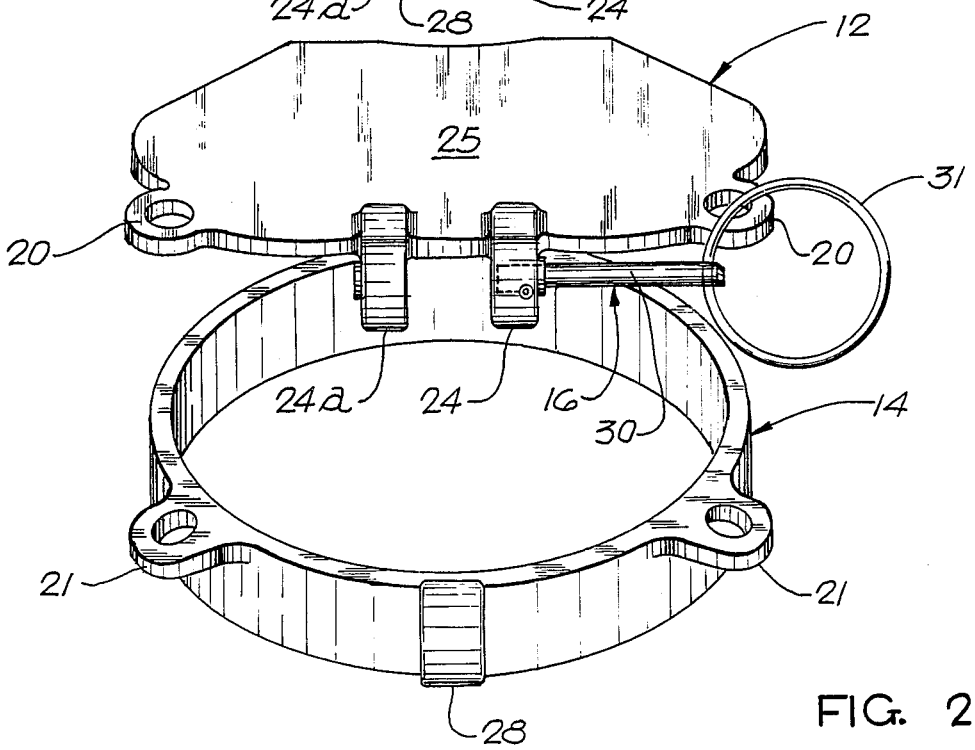
FIG. 2 is another perspective view of the door and lock assembly illustrated in FIG. 1, showing the door in an open position.
Figure 6:
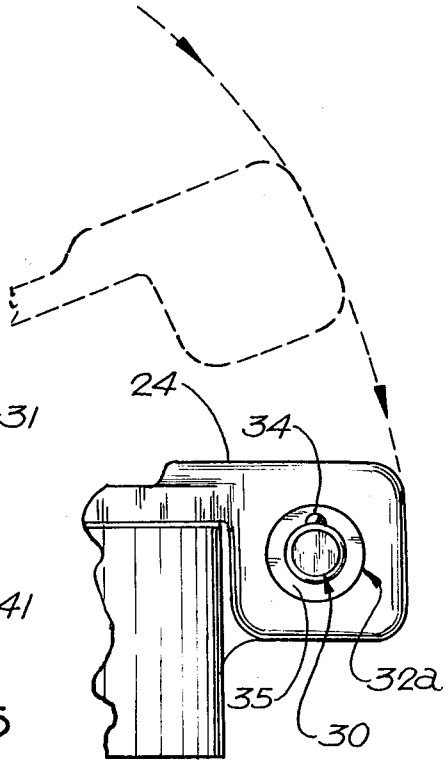
FIG. 6 is a partial elevational view showing the end elevation of the locking bolt associated with the closure door and indicating in phantom the movement path of the door.
Figure 5:
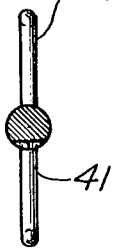
FIG. 5 is a cross sectional view of the locking means taken substantially along vantage line 5—5 of FIG. 3 and locking in the direction of the arrows thereon.

Turning now to the features and details of the preferred embodiment illustrated in the accompanying drawings, particular reference is initially made to FIGS. 1 and 2 from which it will be recognized that a hose storage tube door and lock assembly of this invention is indicated generally by numeral 10 and comprises closure cover means 12, frame means 14 and locking means 16.

The closure means 12 and mounting means 14 preferably are made of cast aluminum or lightweight metal alloy. Means 12 includes coplanar padlock tabs 20,20 which are circumferentially spaced at substantial 4 and 8 o'clock positions at its periphery for cooperation with like disposed and formed open center padlock tabs 21,21 associated with the mounting frame means 14 (see FIG.

2). Spaced hinge ears 22 are formed to project from the underface of the cover means, as illustrated in FIG. 1, for cooperation with spaced ears (not shown) formed integrally with frame means 14. Such cooperating ears receive hinge pin means 23 for pivotally interjoining the cover means 12 to the mounting means 14. In the particular illustrated case, the hinge connection between the cover means 12 and frame means 14 is at the upper end of the assembly as illustrated in FIG. 1.

In addition to the padlock ears 20,20 on cover means 12, the latter is also equipped with a pair of parallel female ear projections **24,24*a* located between the padlock ears 20,20 and generally opposite the hinge connection of the cover means with the support frame means 14 as viewed in FIGS. 1 through 4. The ear projections 24,24*a* are laterally spaced and formed integrally with the main planar body 25 of the cover means 12** to extend transversely outwardly of the periphery thereof.

As best illustrated in FIG. 2 of the drawings, support means 14 comprises a cylindrical member, cast of lightweight metal like cover means 12 and comprising the peripherally extending padlock ears 21,21 previously mentioned. Disposed centrally between ears 21,21 is a radially outwardly extending single male ear projection 28 arranged to interfit with the spaced female ear projections **24,24*a* when the cover means is in its closed position, as shown in FIG. 1**.

Inasmuch as the particular embodiment illustrated and described herein pertains to cover or security doors for use with cylindrical hose storage tubes, the internal diameter of the annular mounting frame 14 is appropriate to coaxially fit over an outer end of an open ended storage tube, typically having a diameter of six to twelve inches. The frame means is appropriately fixed to the outer wall of the storage tube, as by welding.

In order to secure the door 12 in closed position over the mounting means 14, locking means 16 is provided, comprising an elongated cylindrical pin or bolt means 30 having a pull ring 31 secured to one end thereof for axially manipulating the same as will be described presently.

Bolt means 30 is arranged to move coaxially through the male and female ear projections 28 and **24,24*a* associated with the cover and mounting frame means. To that end the several ear projections are formed with central openings which are coaxially aligned when the cover means 12 is closed on the frame means 14. Hardened bushings 32,32*a* are mounted in the central openings associated with ears 24,24*a* to provide for smooth passage of the bolt means 30 therethrough. Bushings 32,32*a* have an internal diameter loosely receptive of the cylindrical body of the bolt or pin means 30. The central opening 33 in the male ear projection is coaxially aligned with bushings 32,32*a*** and of a diameter to permit free passage of the bolt means therethrough.

It will be recognized that when the bolt means is positioned to traverse all three ear projections simultaneously, the cover means 12 is secured in a closed position. This condition is shown in FIG. 1. Conversely, when the bolt means is withdrawn from opening 33 in the male ear projection, the cover means 12 is free to open.

Figure 3:
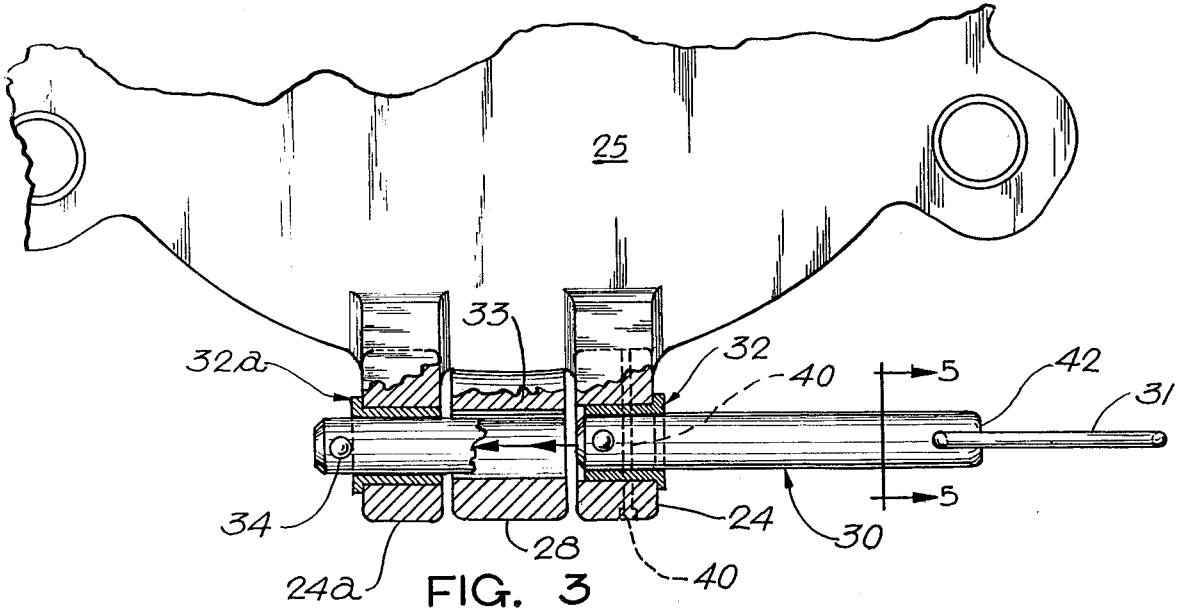
FIG. 3 is an enlarged partial plan view with portions broken away in section to illustrate the locking and releasing position of the locking means and its assembled relationship with the door and support frame.
Figure 4:
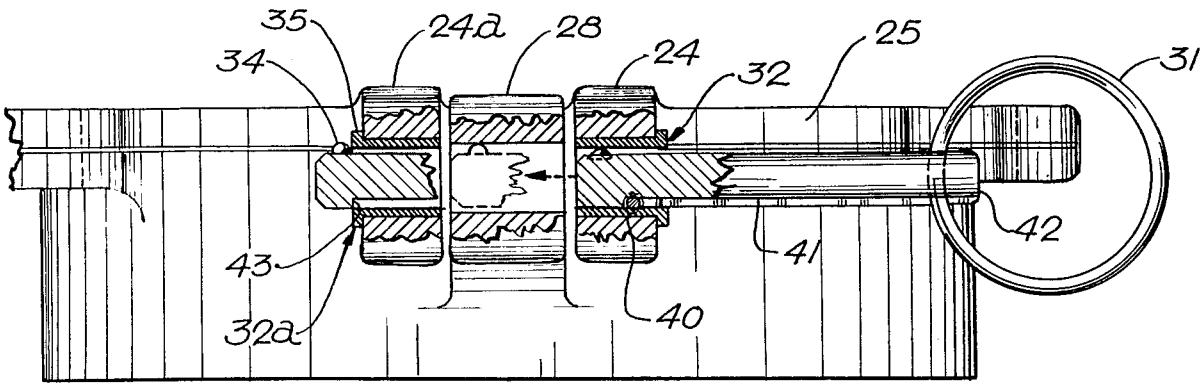
FIG. 4 is a front elevation of the assembly illustrated in FIG. 3.

In order to prevent accidental or vibration induced retraction of the bolt means, sufficient to release the cover means 12, bolt means 30 is provided with a spring loaded ball detent means 34 adjacent its outer end. Consequently, when bolt means 30 is inserted through the ear projections, and more particularly when it is in its locking position as shown in FIGS. 1, 3 and 4, detent means 34 thereon is disposed axially outwardly of and radially interfers with the enlarged head 35 of bushing member **32*a*. Thus the bolt means is removeably restrained against axial movement toward its releasing position i.e., to the right as viewed in FIGS. 3 and 4**.

In addition to the bolt restraining action of the detent means above noted, such also operates to keep the bolt means in a fully withdrawn or retracted position as shown in FIGS. 3 and 4. Specificly, when bolt means 30 is axially shifted to the far right as shown in FIGS. 2–4, the detent means radially engages and presses against the interior walls of the bushing 32 associated with female ear or lug 24, thus restraining the bolt means against movement to the left as viewed in these figures. This is important to operation of the cover door in that it prevents the bolt means from moving to a position where it would interfere with the male ear projection 28 when the door or cover is moved from its "open" position of FIG. 2 to its "closed" condition of FIG. 1.

The locking means 16, is further featured by means which prevents detachment of the bolt means from the female ear projection 24 in the illustrated case. In this latter regard it is to be understood that the organization of parts in the illustrated embodiment hereof is such that the bolt means is positively coupled to the one (right) ear projection 24 so that the bolt means is retracted to the right and lockingly inserted to the left. Reversal of this arrangement is fully contemplated by positively coupling the bolt means to the left hand female ear projection **24*a***, so that the bolt means would be moved in reverse directions from that shown in the drawings and above described.

In order to couple the bolt means to one of the ear projections 24 or **24*a*, as selected, and thereby prevent its disassociation from the assembly, a positive stop means, comprising a hardened metal pin 40, is fixed transversely of the movement axis of the bolt means across the bushing 32 in ear 24 (see FIG. 3). The stop pin 40 invades the cylindrical interior of the bushing in chordal relationship. To permit movement of the bolt means 30 over the pin 40, a flat surface 41 is provided along one side of the bolt, means; such extending from the ring supporting end 42 thereof, substantially along its length; terminating, however, at a transverse stop shoulder 43 adopted to engage the pin 40 (see FIG. 4). When shoulder 43 is engaged with pin 40, the spring loaded detent means 34, holds the lock bolt with resilient force within the bushing 24. Positive axial force on the lock bolt is required to dislodge the lock bolt from this condition, and move the same through the ear projections to lock the door means to the frame means. Bolt movement (to the left in FIGS. 2–4) is positively limited, however, by the pull ring 31, as shown in FIG. 1**. Thus the lock bolt is positively stopped and limited in its axial movements relative to the locking ear projections.

From the foregoing it is believed those familiar with the art will readily appreciate the improved advancement and advantages of the present invention over the prior art and recognize that while the same has herein been described in association with a particular preferred embodiment illustrated in the drawing, the invention hereof is susceptible to modification, change and substitution of equivalents, without departing from its spirit and scope which is intended to be unlimited except as appears in the following appended claims.

The embodiments of the invention in which an exclusive property or privilege is claimed are defined as follows:

1. A system for securing a pivotally moveable closure member to a stationary frame member, comprising: a pair of laterally spaced female projections on one of the members, at least one male projection on the other member aligned to interfit with said female projections; all said projections being formed with transverse through openings and being arranged to lie adjacent one another so that said openings are coaxially aligned when said closure member is is closed position over said frame member; a non-rotatable, elongated bolt slidably attached to one of said female projections for movement coaxially through said aligned openings, manually engageable means at one end of said bolt for manually actuating the same, and detent means adjacent the other end of said bolt and operable to independently engage each of said spaced female projections for removeably retaining said bolt in corresponding first and second positions.

2. The combination of claim 1, wherein said manually engageable means operatively limits movement of said bolt substantially beyond said first position.

3. The combination of claim 1, and stop means on said bolt and one female projection for operatively limiting movement of said bolt beyond said second position.

4. The combination of claim 3, wherein said stop means comprises pin means traversing the opening in said one female projection, and stop shoulder means formed on said bolt for interferingly engaging said pin means.

5. The combination of claim 4, wherein said bolt is formed with a planar surface along a portion of its length, said surface slidably engaging said pin means and thereby preventing rotational movement of said bolt.

6. The combination of claim 1, wherein said detent means comprises spring loaded means arranged to interferingly extend between said bolt and said female projections.

7. As assembly for enclosing the open end of an elongated hose storage tube, comprising: a closure door, a mounting frame adapted to be secured about an open end of a hose storage tube, means for pivotally interconnecting said door to said frame for arcuate opening and closing movements, said door abuttingly overlying said frame when in closed position; first projection means extending outwardly of the periphery of said door for securing the latter to said frame, additional projection means extending outwardly of the periphery of said frame for cooperation with said first projection means, all said projection means being formed with through openings arranged to coaxially communicate when said door is in closed position over said frame; non-rotatable, manually actuated, elongated bolt means rectilinearly moveable through said openings for interlocking said projection means, the same being slidably attached to one of said projection means for axial reciprocating movement; plural stop means for arresting said bolt means at its limits of reciprocating movement, and detent means acting between said bolt means and projection means for removeably retaining said bolt means at its said limits, said bolt means, at one limit of its movement, extending through said openings in all said projection means to lock said door to said frame and, at its other limit of movement, being withdrawn from all but the opening of said one projection means to release said door.

8. The combination of claim 7, wherein said projection means are formed integrally with their associated said door and frame.

9. The combination of claim 7, and manually engageable means on said bolt means for manipulating the same.

10. The combination of claim 9, wherein said stop means comprises, said manually engageable means arranged to engage said one of said projection means for limiting movement of said bolt means in one direction, pin means for traversing the opening in said one of said projection means, and shoulder means on said bolt means for engaging said pin means to limit movement of said bolt means in an opposite direction.

11. The assembly of claim 7, wherein a pair of laterally spaced projection means extend from said door, and a single projection means extends from said frame.

* * * * *